US008034192B2

(12) United States Patent
Ringer et al.

(10) Patent No.: US 8,034,192 B2
(45) Date of Patent: Oct. 11, 2011

(54) METHOD AND SYSTEM FOR COLLECTING PAPER DUST

(75) Inventors: Volker J. Ringer, Kirkland (CA); Alain Chamberland, Pincourt (CA); Rudy Chang, Lasalle (CA); Christine Tourigny, Lasalle (CA)

(73) Assignee: Andritz Fiber Drying Ltd., Lachine (Quebec) (CA)

( * ) Notice: Subject to any disclaimer, the term of this patent is extended or adjusted under 35 U.S.C. 154(b) by 618 days.

(21) Appl. No.: 12/126,385

(22) Filed: May 23, 2008

(65) Prior Publication Data

US 2009/0126764 A1 May 21, 2009

Related U.S. Application Data

(60) Provisional application No. 60/988,447, filed on Nov. 16, 2007.

(51) Int. Cl.
*B08B 3/00* (2006.01)

(52) U.S. Cl. ..... 134/115 R; 134/104.2; 134/198; 15/300.1; 15/320; 15/347

(58) Field of Classification Search ..... None
See application file for complete search history.

(56) References Cited

U.S. PATENT DOCUMENTS

| | | | |
|---|---|---|---|
| 2,825,430 | A | 3/1958 | Hooper |
| 3,063,221 | A | 11/1962 | Ortgies et al. |
| 3,763,634 | A | 10/1973 | Alliger |
| 4,019,953 | A | 4/1977 | Nystrom |
| 4,272,499 | A | 6/1981 | Cason et al. |
| 5,088,913 | A | 2/1992 | Chambers |
| 5,219,585 | A | 6/1993 | Shealy et al. |
| 5,635,031 | A | 6/1997 | Enkvist |
| 5,800,679 | A | 9/1998 | Lindstrom et al. |
| 5,878,462 | A | 3/1999 | Linden et al. |
| 6,014,790 | A | 1/2000 | Smith et al. |
| 6,068,735 | A | 5/2000 | Marchal |
| 6,176,898 | B1 | 1/2001 | Courtney et al. |

*Primary Examiner* — Michael Kornakov
*Assistant Examiner* — Eric Golightly
(74) *Attorney, Agent, or Firm* — Nixon & Vanderhye P.C.

(57) ABSTRACT

Methods and systems for collecting dust produced in paper making involve an air inlet passage including an opening to receive dust laden air. The opening to the inlet passage may have a width approximately equal to a width of a paper web in a paper making machine. The air inlet passage is devoid of water injection. The dust collector may include a central vortex chamber and may be defined by an outer wall and an internal guide vane. There may be a water injector mounted in the outer wall and injecting water into the central vortex chamber, and there may be a discharge outlet of the central vortex chamber connectable to a water and air separator.

6 Claims, 5 Drawing Sheets

METHOD AND SYSTEM FOR COLLECTING PAPER DUST

RELATED APPLICATION

This application claims the benefit of U.S. Patent Application Ser. No. 60/988,447 filed Nov. 16, 2007, which is incorporated by reference in its entirety.

BACKGROUND OF THE INVENTION

This invention relates to dust collection and, specifically, to the collection of paper dust generated by papermaking machines, such as tissue making machines.

Dust, e.g., paper fibers and other small air borne debris, is formed during the production of tissue paper and other types of paper. The amount of dust generated by paper making machines (e.g., tissue making machines) has increased as the speed increases of the paper webs passing through paper making machines. Greater amounts of dust tend to be created with paper machines that produce soft tissue paper and papers having high crepe ratios.

There is a need to remove dust produced during paper making processes. Dust removal is needed to avoid problems that may arise with dust collecting on the paper making machines and paper webs formed by these machines. Removal of substantial portions of the dust generated by paper making allows for improved paper quality and printability of the generated papers.

Conventional dust removal systems, such as disclosed in U.S. Pat. No. 6,176,898 ('898 Patent), utilize various shapes of exhaust cross machine headers. Dust collectors typically uses large amount of exhaust air to evacuate the dust developed during the paper making process. The '898 Patent discloses a dust collection cylinder having an interior air vortex and water spray that entrains dust laden air as soon as the air enters the collector. In the dust collector shown in the '898 Patent, the inlet to the dust collector is short and recessed with respect to the cylindrical collector such that the dust laden air is immediately wetted by the vortex of air and water within the collector.

SUMMARY OF INVENTION

A novel dust collection and removal system has been developed that includes a volute center chamber within which a vortex of air, dust and water circulate and from which are discharged. The system may include an extended inlet to collect dust laden air. The inlet may include a narrow throat to accelerate the air. Downstream of the inlet is a curved passage into which or after which water is injected. The dust in the air may become entrained by water droplets. The mixture of air and water droplets with dust flow from the passage into the vortex formed in the center section of the volute. An outlet at one end of the center section may discharge the mixture of air, dust and water and may apply a suction to the center section to form the vortex.

In an embodiment, a novel dust collection and removal system includes an extended inlet allows the opening to the inlet to be positioned near a tissue web or other source of dust. The dust laden air that enters the inlet, may be accelerated into a high velocity stream. Water may be injected into or after the stream to entrain the dust. The air, dust and water flow into a vortex in the center of the system. From the center of the system, the mixture of air, dust and water is discharged where the air is separated from the dust and water mixture. An exhaust fan may apply a suction to the discharge outlet to create the vortex in the center of the system. The system may effectively collect air borne dust at or near a paper making machine, e.g., a tissue machine, mixes the dust with water, and may discharge the water and dust mixture for waste water processing.

In an embodiment, the dust collection and removal system may include a variable length inlet section that has a width that extends the full width of a tissue web so as to entrain the dust particles. Downstream of the extended inlet, the dust laden air may be showered with one or more water sprays to capture the dust particles in water droplets entrained in the air flow. The system may also allow from variation of the air inlet velocity at the opening to the inlet. A throat towards the back of the dust extractor may be adjust to control the velocity of the air entering the inlet. Inlet velocities can be controlled manually or automatically. This feature regarding inlet velocity control allows fine tuning to various machine speeds and paper grades.

In an embodiment, a method has been developed to collect and handle dust in a papermaking environment including: drawing dust-laden air into an opening of an inlet of a collector at a selected velocity, wherein a velocity of the air drawn into the opening is dependent on a cross-sectional area of the inlet slot; injecting water into the air flowing through the collector, wherein the water is introduced downstream of the inlet and dust in the air attaches to the injected water; inducing an vortex in the flow of water, dust and air in a chamber of the collector, and discharging the water, dust and air from the collector.

The inlet may be extendible, such as by a fixed or telescoping an opening of the inlet to an area proximate to a paper web or other source of dust. The injection of water may include spraying the water through one, two, or a row of water nozzles mounted to an outer wall of the collector. Further, the injection of water may be into an passage downstream of the inlet and upstream of the vortex. Alternatively, the injection of water may be downstream of an inlet.

The passage may be formed by an outer wall of the collector and an internal guide vane. The collector may include a volute, wherein the throat of the inlet is between an outer wall of the volute and an interior scroll of the volute. Further, the interior scroll may form a guide vane directing the air, dust and water to the vortex in a center chamber of the volute.

In an embodiment, a dust collector has been developed comprising: an air inlet passage including an opening to receive dust-laden air and a throat proximate to an outlet of the inlet, wherein the opening to the inlet passage has a width approximately equal to a width of paper web in a paper making machine and the throat has a cross-sectional area smaller than a cross-sectional area of the opening; an inlet guide vane passage extending from the throat to a central vortex chamber and defined by an outer wall of a volute and an internal guide vane of the volute, wherein the outer wall and internal guide vane are formed of a continuous sheet; a water injector mounted in the outer wall and injecting water into the passage; the central vortex chamber defined by the volute and coaxial with the volute, and a discharge outlet of the central vortex chamber connectable to a water and air separator and a source of air suction.

The cross-sectional area of the throat or inlet may be adjustable, such as by the use of a clamp extending between the outer wall of the collector and an internal guide vane. The inlet passage may be curved and substantially straight. The air inlet passage may be devoid of water injection.

In an embodiment, there is a dust collector comprising: an air inlet passage including an opening to receive dust laden air, wherein the opening to the inlet passage has a width approximately equal to a width of a paper web in a paper making machine, wherein the air inlet passage is devoid of water injection; a central vortex chamber and defined by an outer wall and an internal guide vane; a water injector mounted in the outer wall and injecting water into the central vortex chamber; and a discharge outlet of the central vortex chamber connectable to a water and air separator.

DETAILED DESCRIPTION OF THE INVENTION

Figure 1:
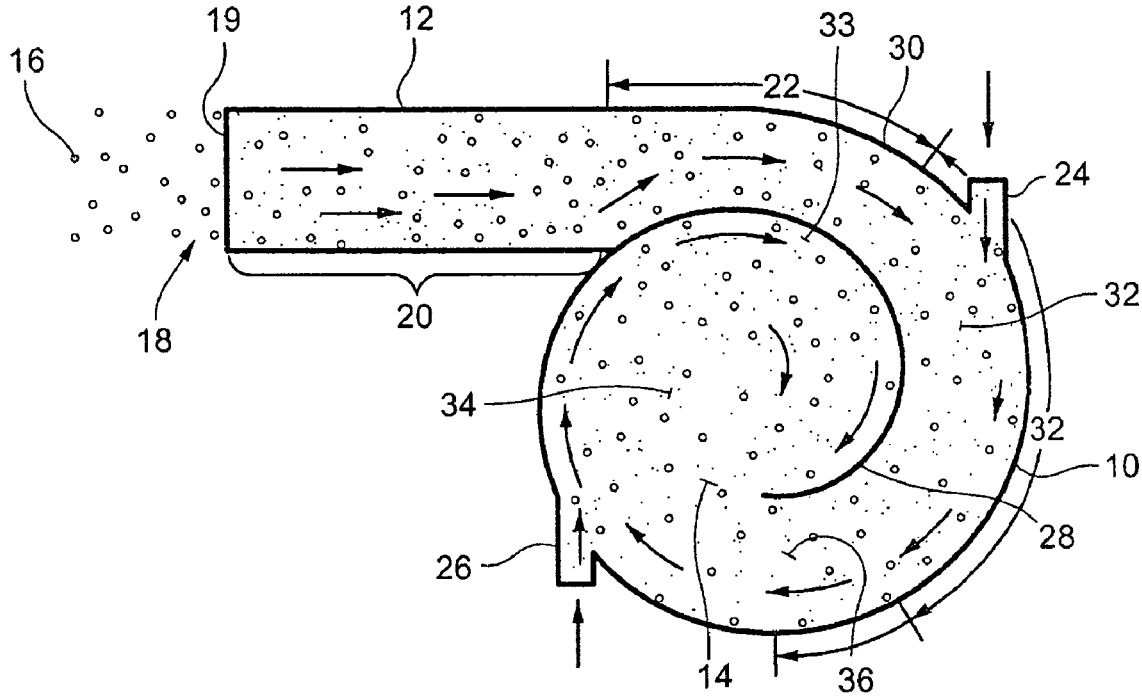
FIG. 1 is a schematic cross-section diagram of an embodiment of the dust collection and removal system.

FIG. 1 shows in cross-section an embodiment of a dust collector and removal system 10 having an extended inlet 12 for dust collection and a volute section 14 for dust removal. Dust laden air 16 is pulled into an opening 18 of the inlet and passes through a dry, generally straight inlet section 20. The section 22 of the inlet has a specific cross-sectional area that causes the velocity of the dust laden air passing through the inlet. The accelerated dust and air enter the volute section 14 where the fast moving dust laden air is mixed with a water spray and rotated to form a vortex. Water is injected tangentially by one or more water injectors 24, 26 arranged in the volute section. An internal vane guide 28 guides the dust laden air to form the vortex. The dust and water laden air is removed from the vortex section at one of the ends of the collector and removal section.

The collector and removal system 10 may be formed of a sheet metal, such as a galvanized steel to minimize corrosion. The interior surfaces of the system 10 may be optionally coated with a plastic material or be formed of a plastic liner to prevent water from leaking from joints in the system.

The inlet section 20 may be generally rectangular in cross-section, but other cross-sectional shapes such as race-track, oblong, oval, and elliptical may be suitable for particular applications. The cross-sectional area of the inlet is preferably constant from the opening Preferably, the width of the inlet section and particularly the opening 18 is approximately, e.g., within 10%, the width of the tissue machine or the tissue web being formed by the machine. Similarly, the length of the volute section 14 is preferably approximately the width of the inlet section and also approximately the width of the tissue machine.

The opening 18 of the inlet may be positioned adjacent the web or proximate a section of the machine that tends to generate dust. The inlet section may include an initial straight section 20. The length of the straight section 20, e.g., one foot to ten feet, is subject to design considerations, such as the position of the dust collector and removal system with respect to the tissue machine and an optimal location for the opening 18 to the inlet.

An extended inlet section 20 allows for the placement of the opening 18 for the dust collector and removal system 10 to at small or confined locations near the tissue web or machine that would not allow for the placement of the volute section 14. The length of the inlet may be selected during a design phase of the dust collector and removal system 10. Optionally, the length of the inlet may be adjusted, such as by telescoping the inlet which may be formed of multiple rectangular ducts which slide one into the other. The extended inlet allows the opening 18 to be positioned at locations where there may be insufficient space for the volute section. While the inlet 12 is shown as being straight, it may be curved, bent or otherwise shaped to fit into irregular spaces near the tissue machine and arranged to position the opening 18 proximate the tissue web or other source of dust on the machine. The opening may include a series of bars or a grid 19 that prevents large material, e.g., sections of a web, from being drawn into the opening 18 and entering the interior of the dust collector and removal system 10.

The throat 22 of the inlet 12 may have a smaller cross-sectional area than does cross-section area of the straight section 20 of the extended inlet 12. A reduced cross-sectional area of the throat may accelerate the dust laden air 16 passing through the dry inlet. The acceleration of the air creates a relatively high velocity air flow through the inlet section 22. The acceleration and the high velocity air encourages mixing of the dust in the air, tends to prevent dust from accumulating on the sides of the inlet and imparts kinetic energy to the dust and the air flow.

The inlet 22 is between the section 20 and the volute section 14. The throat 22 may have a curvature due to the curved internal guide vane 28 and the curved outside housing wall 30 of the volute section 14 of the dust collector and removal system 10. The outside housing wall 30 may be formed from a metallic sheet wrapped to from a scroll, wherein an outer portion of the scroll defines the outside housing wall and an interior section of the scroll forms the internal guide vane 28.

The cross-sectional area of the inlet 22, e.g., the height of the inlet between the outside housing wall and the internal vane guide, may be selected to provide optimal acceleration of the air flow. Optionally, the cross-sectional area of the inlet may be adjusted to change the air flows, e.g., rate of air flow and velocity, to suit various operating conditions.

As the dust laden air passes through the inlet and enters the passage section 32 of the volute between the outer housing wall 30 and the internal vane guide 28. In the illustrated embodiment, the expanded section is a curved passage between the throat and an open generally cylindrical chamber 34 at a center section 34 of the volute. The cross-sectional area of the expanded section may be generally larger than the cross-sectional area of the throat 22. The cross-sectional area of the passage section 32 can be initially relatively small near the throat and increases as the passage curves around the volute and extends to a passage outlet 36. As the dust laden air flows through the inlet passage section 36, the air flow is turned to flow in a circular path and thereby to start a vortex air flow. At the outlet 36, dust laden air flows into the center section 34 of the volute. The air flows in a circular path, e.g., a vortex, in the center section. The circular air flow path is initiated by the curvature of the inlet vane section. The vortex flow in the center section of the volute causes the dust laden air to circulate within the volute.

Water or other liquid is injected downstream of the throat 22 and into the air flow passing through the passage section 32. The water is preferably injected by nozzle(s) 24 as a mist, spray or droplets that entrain the dust in the air flow. As the water mixes with the air, dust in the air attaches to the water. The water is preferably injected as sufficiently fine droplets and into an airflow at a sufficient velocity such that the water remains in the airflow. However, some water may accumulate on the interior walls of the passage section and the center section of the volute. The water on the walls tends to wash the walls and remove dust from the walls.

The water injector 24 may be multiple or single spray nozzles arranged to project water into the air flow in the passage section 32. For example, the water injector may be a row of water nozzles mounted on the outside housing wall 30 and arranged to inject water tangentially into the curved passage 32. The nozzles may be arranged along the entire length of the outer housing wall. Further the water injectors may be positioned slightly downstream, e.g., within six inches to two feet, of the narrow most section of the throat so that the water enters a relatively high velocity air flow.

The optional second water injector 26 may be mounted in the outer housing wall 30 and arranged to inject water directly into the center section of the volute 43. The second water injector 26 may be one or multiple water nozzles arranged in the outer housing wall and projecting water into the center section. One or more water nozzles 26 may be arranged at one end of the center section such that water is sprayed into the vortex formed in that section. In this configuration, the water nozzles are mounted on an end wall 42 of the outer housing shown in FIG. 2. Alternatively or in addition to, the water nozzles 26 may be arranged in a row along the curved side wall 30 of the center section and inject water tangentially to the vortex flow in the center section.

Figure 2:
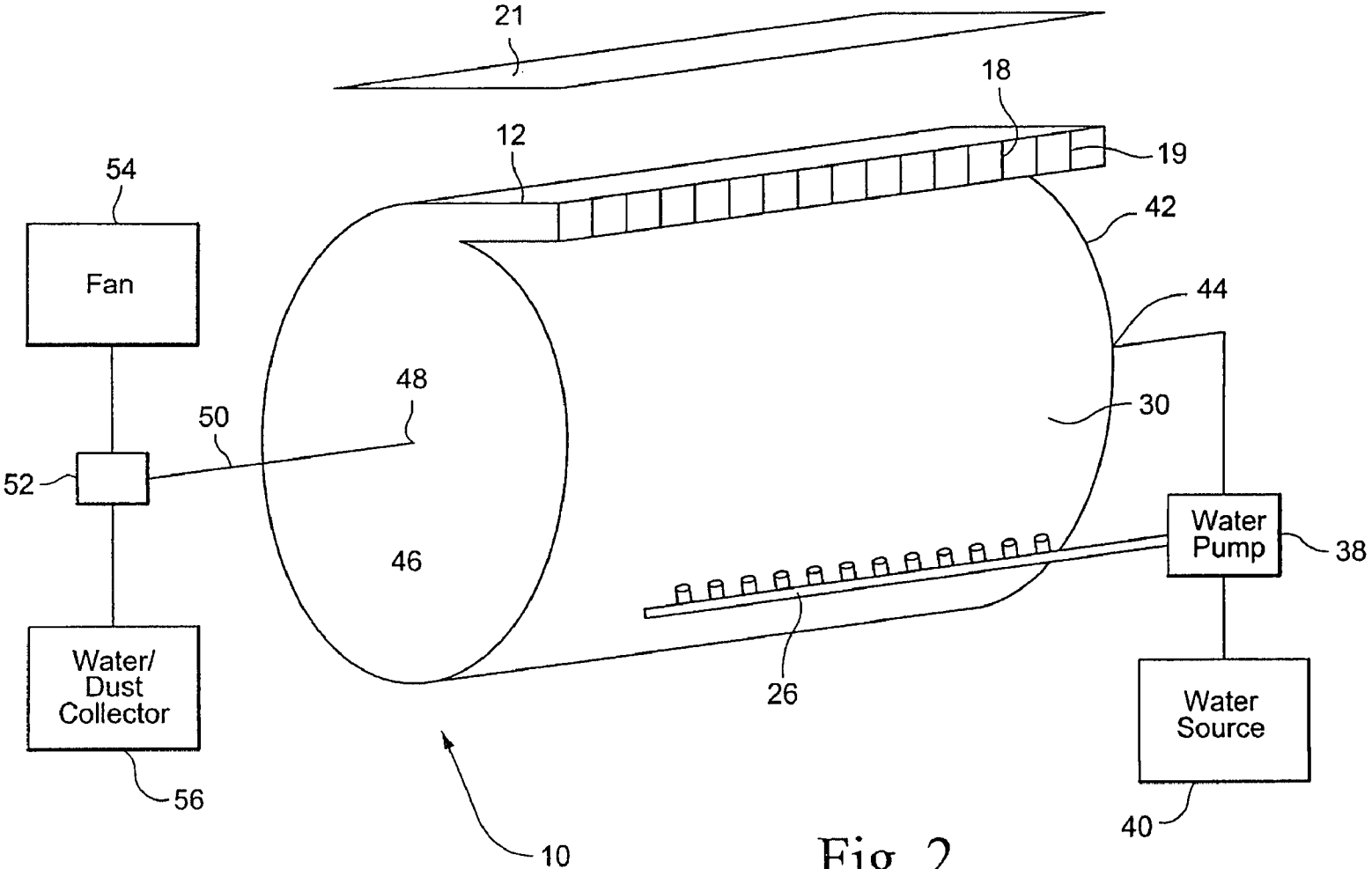
FIG. 2 is a schematic diagram showing a perspective view of an embodiment of a dust collection and removal system including a water supply, water and dust collector and a vacuum source.

FIG. 2 is a perspective view of an embodiment of the dust collector and removal system 10 showing a water pump 38 supply water to the water injectors 22, 26 from a water source 40. The water pump provides water to the water injections, such as a row of water nozzles 26 and to a water nozzle 44 mounted on end wall 42.

A second end wall 46, opposite to the first end wall 42, includes a water and air flow outlet 48 that may be a tapered duct coupled to the second end wall. A suction is applied to the outlet to draw air and water from the center section 34. The suction at least partially creates the vortex within the center section. The vortex is also formed by the tangentially injected water sprays from injectors 24 and 26, and the tangential flow of air from the passage section into the center section.

To create suction and to extract the air and water, a conduit 50 directs the dust and water laden air into a separator 52, e.g., cyclone, that has an upper outlet coupled to a vacuum source such as a fan 54 and that has a lower drain that flows to a water and dust collector 56. The dust may be filtered from the water using conventional water processing techniques.

Figure 3:
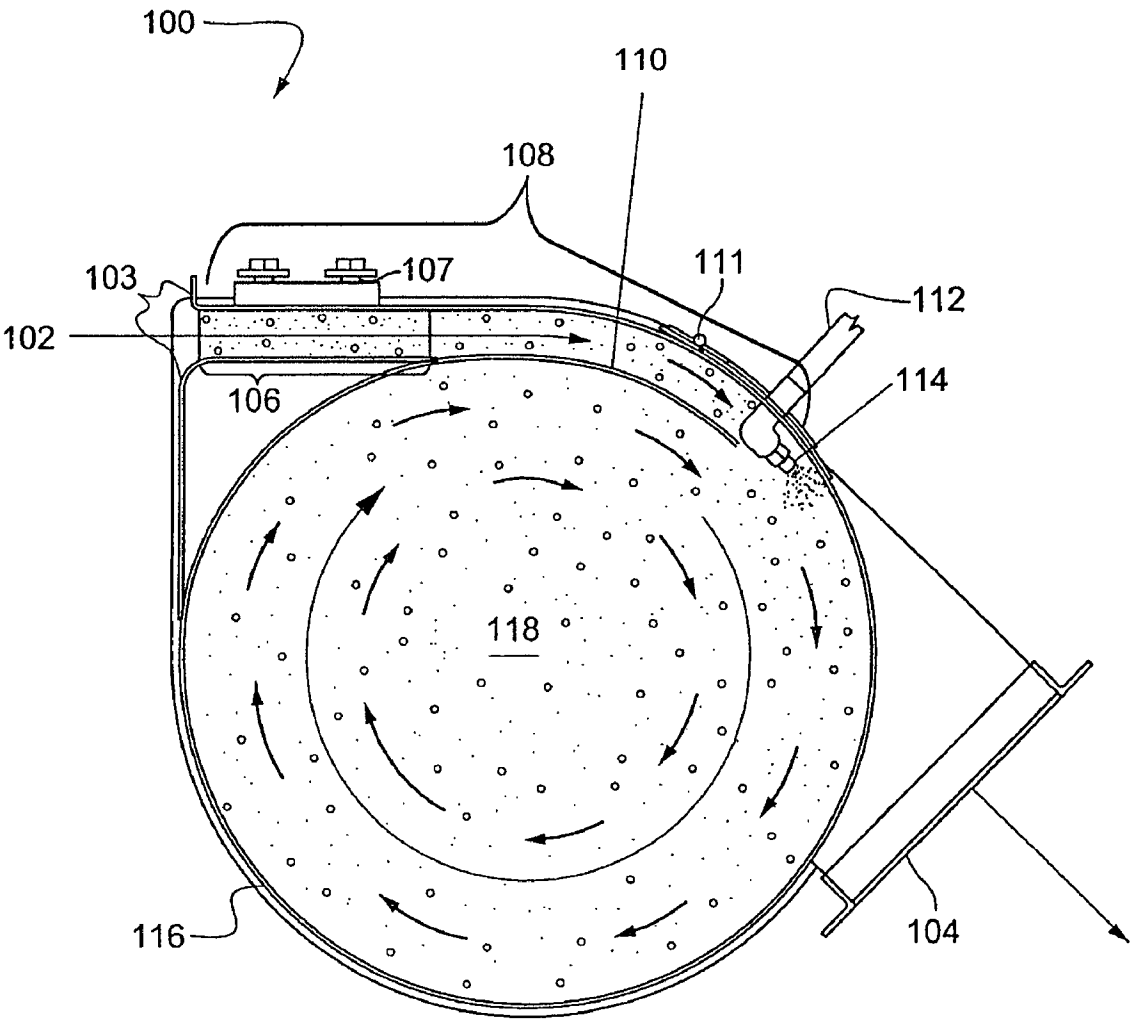
FIG. 3 is a schematic cross-section diagram of the embodiment of the dust collection and removal system illustrated in FIG. 2.

FIG. 3 illustrates in cross-section an embodiment of a dust collector and removal system 100 having an extended inlet 108 for dust collection and removal. Dust laden air 102 is pulled into an opening 103 of the inlet and passes through a dry, generally straight inlet (e.g., throat) section 106. The structure defining opening 103 may optionally be bell-shaped or otherwise curvilinear. The inlet 108 may have an approximately constant or variable cross-sectional area. As illustrated, the height of the inlet section may be 5 to 15% of the diameter of the substantially cylindrical chamber 108. The dust and air tangentially enter a substantially cylindrical chamber 108 at the discharge of the inlet which is between wall 116 and the rear edge of internal guide vane 110. There are one or more attachment mechanisms, e.g., bolts 107 as illustrated, that permit attachment of the dust collector and removal system 100 close and/or near a tissue or paper sheet. As illustrated, bolts 107 are near opening 103 along the generally straight inlet section 106.

Dust-laden air enters the opening 103 of the inlet 108 and flows through the generally straight inlet section 106. The air flows into a curved section of the inlet between the wall 116 of the cylindrical chamber 118 and the inlet guide vane 110. The curvature of the inlet induces a rotational flow to the air that promotes a vortex in the chamber 118. The air flow through the inlet may be fast, thus having a high potential energy. The curvature of the inlet directs the air flow such that the energy of the flow is effectively applied to create the vortex.

As the dust-laden air enters the cylindrical chamber 108, water is injected tangentially by one or more water injectors 112 through nozzles 114. Hinge 111 permits panel access to water injectors 112 and nozzles 114 so as to permit cleaning or repositioning of nozzles 114, repairs, etc. An internal vane guide 110 guides the dust laden air to form a vortex. Hinge 111 also may facilitate access to the curved portion of inlet 108 defined by internal vane guide 110.

The dust and water laden air is removed from the vortex section at one of the ends of the collector though exit 104. As illustrated, exit 104 is disposed approximately perpendicularly to the center axis of the cylindrical chamber 108, such that the dust and water laden air exits through an opening in the wall 116 (and not solely through an opening in the top or bottom of the cylindrical chamber). The substantially cylindrical shape of the chamber 108, the tangential entry of the dust-laden air, and the tangential spray of water through nozzles 114 individually and collectively facilitate the formation of a vortex in the direction of the arrows illustrated in FIG. 3.

Water or other liquid is injected downstream of the inlet 108 and into the air flow passing into the substantially cylindrical chamber 108. The water is preferably injected by nozzle(s) 114 as a mist, spray or droplets that entrain the dust in the air flow. As the water mixes with the air, dust in the air attaches to the water. The water is preferably injected as sufficiently fine droplets and into an airflow at a sufficient velocity such that the water remains in the airflow. The water may also wash the walls 116 of the substantially cylindrical chamber 108 so as to prevent dust build-up thereon.

The water injector 112 may include multiple or single spray nozzles arranged to project water into the air flow in chamber 108. For example, the water injector may be a row of water nozzles mounted on the outside wall arranged to inject water tangentially in the same direction as the air flow exiting inlet 108. The nozzles may be arranged along the entire length of the outer housing wall.

After exiting exit 104, the mixture of dust, air, and water may be separated using a separator, e.g., a cyclone, that has an upper outlet coupled to a vacuum source and that has a lower drain that flows to a water and dust collector. The dust may be filtered from the water using conventional water processing techniques.

Figure 4:
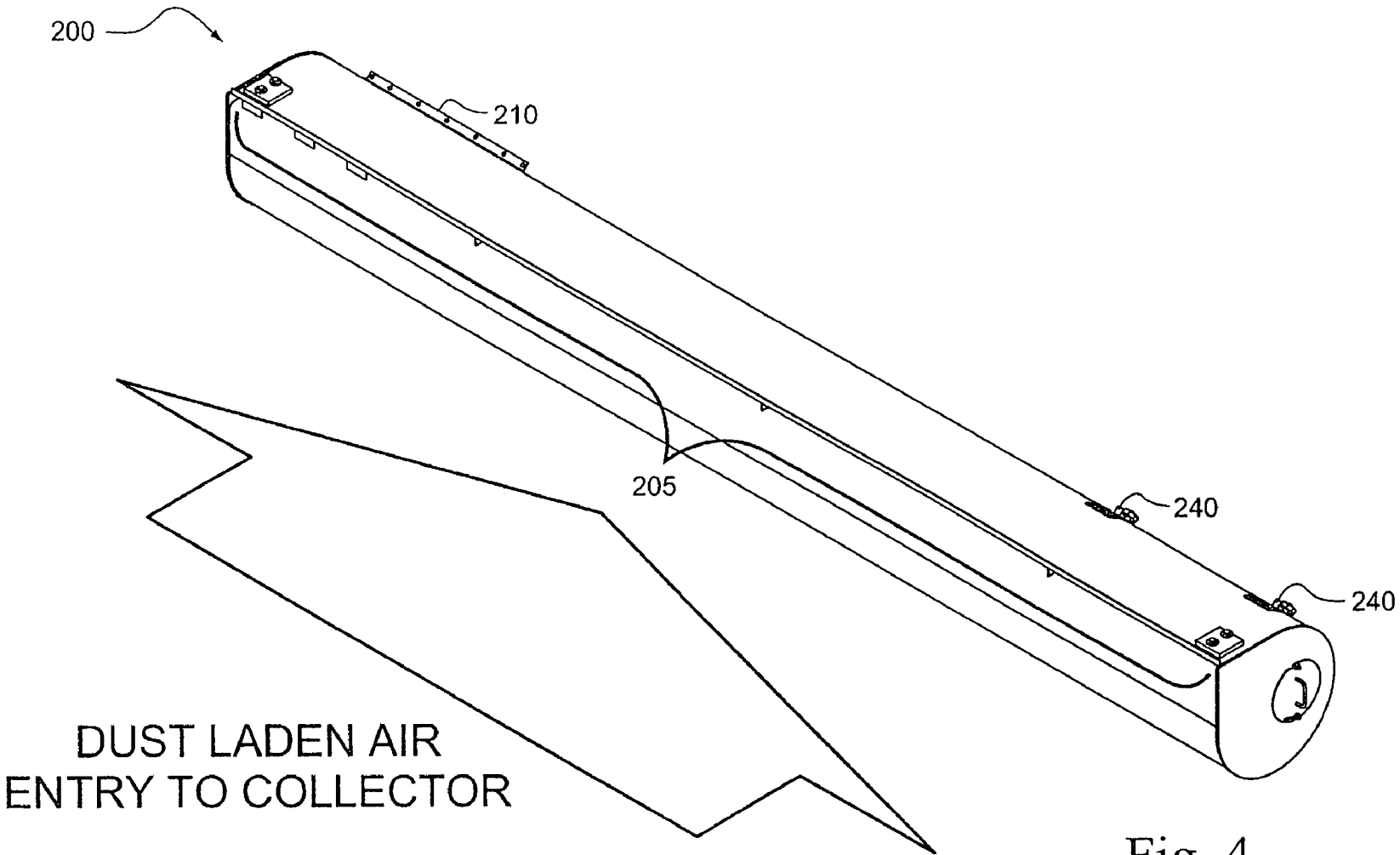
FIG. 4 is a perspective view of an embodiment of the dust collection and removal system.
Figure 5:
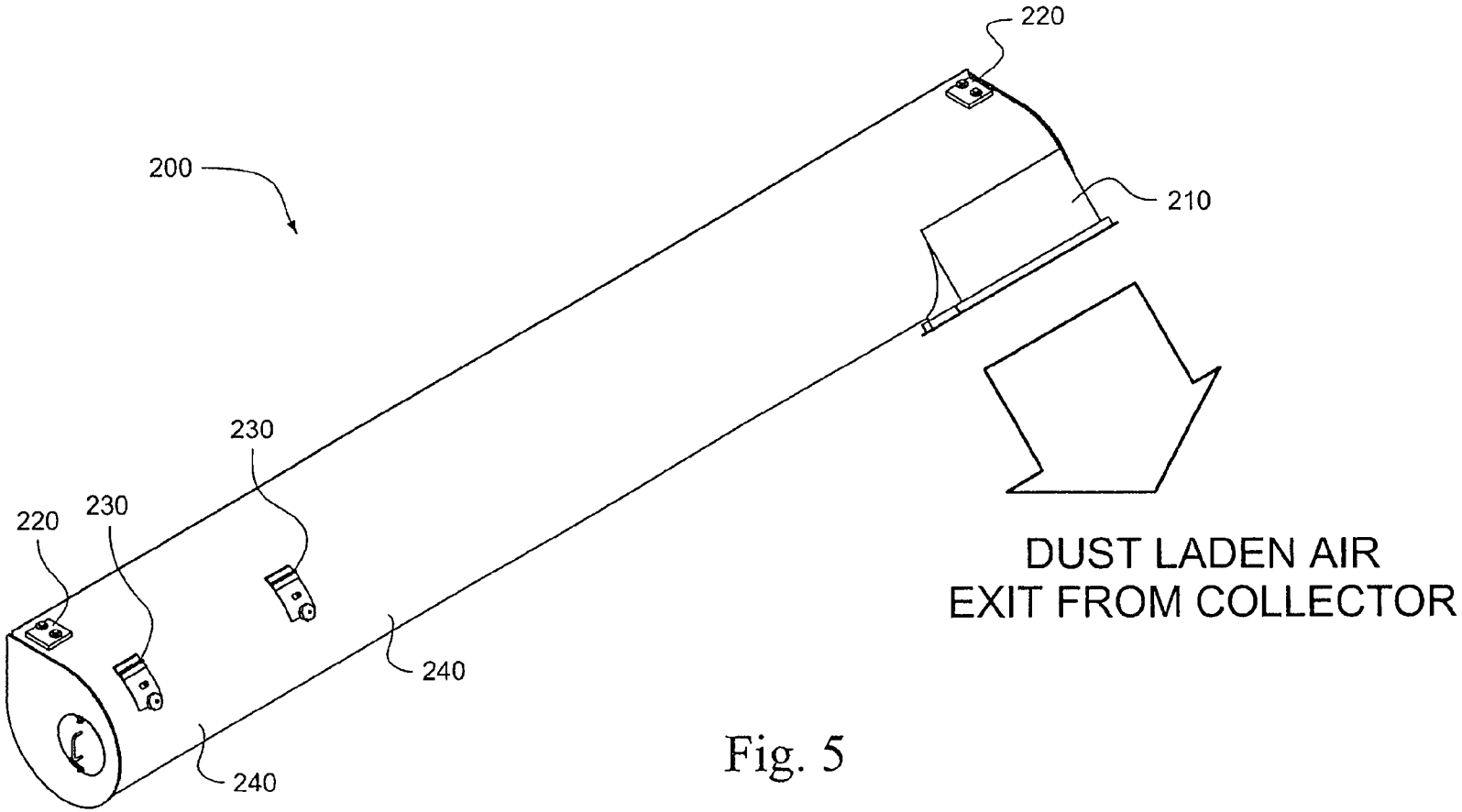
FIG. 5 is a perspective view of an embodiment of the dust collection and removal system.

FIGS. 4 and 5 illustrate perspective views of collector 200 in accordance with an embodiment of the present invention. As illustrated, there is an opening 205 to collector 200 extending substantially along the entire length of the collector (e.g., matching the width of a sheet of tissue or paper). There is an exit 210 positioned at or near one end of the collector 200. As illustrated, exit 210 may extend 10 to 20% from one end of collector 200 (i.e., its axial length), although in certain embodiments exit 210 may extend up to 100% of the axial length of the collector. Furthermore, there may be multiple exits positioned throughout the collector 200. Furthermore, there are access panels 240 and hinges 230, which facilitate access to water injectors and their nozzles (not shown). Attachment bolts 220 are similarly illustrated at or near the ends of collector 200.

All numerical measurements and ranges as described and claimed are approximate and include at least some degree of variation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dust collector comprising:

an air inlet passage including an opening to receive dust laden air and a throat proximate to an outlet of the inlet, wherein the opening to the inlet passage has a width approximately equal to a width of a paper web in a paper making machine and the throat has a cross-sectional area smaller than a cross-sectional area of the opening;

an inlet guide vane passage extending from the throat to a central vortex chamber and defined by an outer wall of a volute and an internal guide vane of the volute, wherein the outer wall and internal guide vane are formed of a continuous sheet;

a water injector mounted in the outer wall and injecting water into the passage or into the central vortex chamber;

the central vortex chamber defined by the volute and coaxial with the volute; and a discharge outlet of the central vortex chamber connectable to a water and air separator and a source of air suction.

2. The dust collector of claim 1, wherein the cross-sectional area of the inlet is adjustable.

3. The dust collector of claim 2, wherein the inlet includes an adjustable clamp to adjust the cross-sectional area of the throat.

4. The dust collector of claim 1, wherein the inlet guide vane passage is curved and the air inlet passage is substantially straight.

5. The dust collector of claim 1, wherein the air inlet passage is devoid of water injection.

6. The dust collector of claim 1, wherein the discharge outlet of the central vortex chamber is disposed substantially perpendicular to a central axis of the central vortex chamber.

* * * * *